US009874382B2

(12) United States Patent
Ali

(10) Patent No.: US 9,874,382 B2
(45) Date of Patent: Jan. 23, 2018

(54) REFRIGERATION SYSTEM WITH FULL OIL RECOVERY

(71) Applicant: Heatcraft Refrigeration Products LLC, Richardson, TX (US)

(72) Inventor: Masood Ali, Hatchechubbee, AL (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 222 days.

(21) Appl. No.: 14/742,751

(22) Filed: Jun. 18, 2015

(65) Prior Publication Data

US 2016/0010907 A1 Jan. 14, 2016

Related U.S. Application Data

(60) Provisional application No. 62/022,697, filed on Jul. 10, 2014.

(51) Int. Cl.
*F25B 43/02* (2006.01)
*F25B 31/00* (2006.01)

(52) U.S. Cl.
CPC ..... *F25B 43/02* (2013.01); *F25B 31/004* (2013.01)

(58) Field of Classification Search
CPC .. F25B 43/02; F25B 2339/046; F25B 31/004; F25B 7/00
See application file for complete search history.

(56) References Cited

U.S. PATENT DOCUMENTS 5,242,475 A * 9/1993 Stine ..... B01D 46/0031 55/319
6,673,135 B2 * 1/2004 West ..... B01D 17/0211 55/323
2001/0023594 A1 9/2001 Ives
2003/0014951 A1 * 1/2003 Crouse ..... B01D 45/06 55/322
2003/0091494 A1 * 5/2003 Zimmern ..... B01D 5/0027 423/352
2007/0214827 A1 9/2007 Venkatasubramaniam
2009/0272128 A1 * 11/2009 Ali ..... F25B 7/00 62/56
2011/0056379 A1 * 3/2011 Lucas ..... B01D 45/12 96/216
2015/0096315 A1 * 4/2015 Li ..... F25B 43/00 62/115

* cited by examiner

*Primary Examiner* — Elizabeth Martin
(74) *Attorney, Agent, or Firm* — Baker Botts L.L.P.

(57) ABSTRACT

The present application provides a refrigeration system with full oil recovery for removing oil from a flow of a refrigerant. The refrigeration system may include a compressor, an oil separator positioned downstream of the compressor to remove most of the oil from the flow of the refrigerant, a condenser positioned downstream of the oil separator, and a receiver positioned downstream of the condenser. The receiver may include a barrier to separate the oil on a first side from the refrigerant on a second side.

17 Claims, 4 Drawing Sheets

REFRIGERATION SYSTEM WITH FULL OIL RECOVERY

RELATED APPLICATIONS

The present application is a non-provisional application claiming priority to U.S. Ser. No. 62/022,697, entitled "Refrigeration System with Full Oil Recovery," filed on Jul. 10, 2014. U.S. Ser. No. 62/022,697 is incorporated herein by reference in full.

TECHNICAL FIELD

The present application and the resultant patent relate generally to refrigeration systems and more particularly relate to a cascade refrigeration system with a high side full oil recovery system.

BACKGROUND OF THE INVENTION

Cascade refrigeration systems generally include a first side cooling cycle, or a high side cycle, and a second side cooling cycle, or a low side cooling cycle. The two cooling cycles interface through a common heat exchanger, i.e., a cascade evaporator/condenser. The cascade refrigeration systems may provide cooling at very low temperatures in an efficient manner.

The compressors in these cooling cycles of a cascade refrigeration system generally require a source of oil in communication with the flow of refrigerant therein. Any oil that may be trapped in the refrigerant vapor downstream of the compressors then may be removed via an oil separator and the like. Periodic recovery of the compressor oil also may be required. This oil recovery may be performed automatically on the low side cycle but manual draining may be required on the high side cycle due to the high pressures involved. Such manual oil recovery may be expensive and inefficient.

There is thus a desire for refrigeration systems such as cascade refrigeration systems with improved oil recovery systems. Preferably such improved oil recovery systems may provide full oil recovery in a high side cooling cycle in an efficient manner without the use of manual techniques or the use of complex or expensive mechanisms.

SUMMARY OF THE INVENTION

The present application and the resulting patent thus provide a refrigeration system with full oil recovery for removing oil from a flow of a refrigerant. The refrigeration system may include a compressor, an oil separator positioned downstream of the compressor to remove most of the oil from the flow of the refrigerant, a condenser positioned downstream of the oil separator, and a receiver positioned downstream of the condenser. The receiver may include a barrier to separate the oil on a first side from the refrigerant on a second side for efficient recovery.

The present application and the resultant patent further provide a method of removing oil from a flow of refrigerant in a refrigeration system. The method may include the steps of removing most of the oil in an oil separator, condensing the refrigerant in a condenser, flowing the refrigerant to a receiver, separating the remaining oil in the refrigerant on one side of a barrier in the receiver, and accumulating the remaining oil in an oil pot. The oil may be drained via an oil port in the oil pot in a fast and efficient manner.

The present application and the resultant patent further provide a full oil recovery system for removing oil from a flow of an ammonia refrigerant in a refrigeration system. The full oil recovery system may include a coalescing oil separator and a receiver. The receiver may include a weir plate to separate the oil on a first side from the ammonia refrigerant on a second side.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
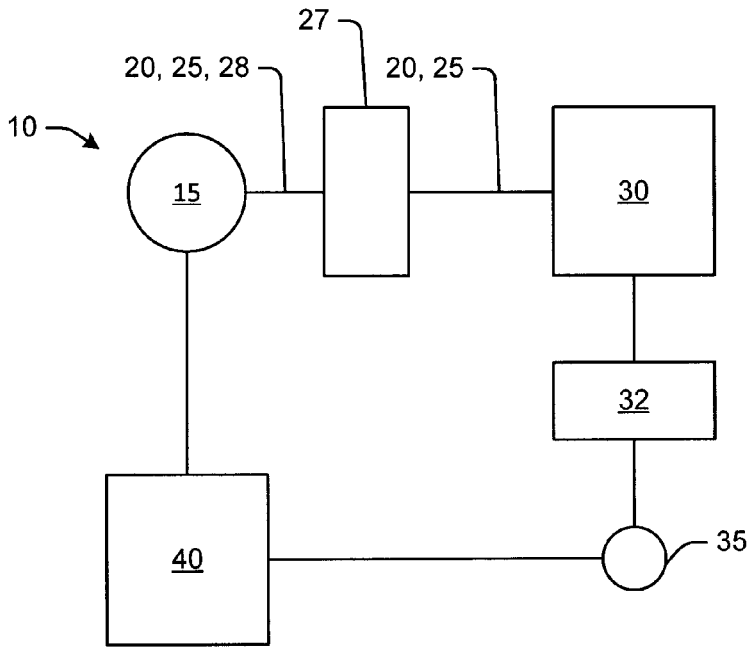
FIG. 1 is a schematic diagram of a known refrigeration system.

Referring now to the drawings, in which like numerals refer to like elements throughout the several views, FIG. 1 shows an example of a known refrigeration system 10. The refrigeration system 10 may be used to cool any type of enclosure for use in, for example, supermarkets, cold storage, and the like. The refrigeration system 10 also may be applicable to heating, ventilation, and air conditioning and/or different types of industrial applications. The overall refrigeration system 10 may have any suitable size or capacity.

Generally described, the refrigeration system 10 may include a compressor 15. The compressor 15 may have any suitable size or capacity. The compressor 15 may compress a flow of refrigerant 20 at a high pressure and high temperature. In this example, the refrigerant 20 may be a flow of ammonia ($NH_3$) 25. Other types of refrigerants 20 also may be used herein. An oil separator 27 may be positioned downstream of the compressor 15. The oil separator 27 may remove most of any oil 28 that may remain in the flow of the refrigerant 20. The oil separator 27 may have any suitable size or capacity. The oil separator may direct the flow of oil 28 to an oil pot and the like.

The refrigeration system 10 may include a condenser 30 or other type of heat exchanger positioned downstream of the compressor 15. The condenser 30 may have any suitable size or capacity. The condenser 30 may cool the flow of refrigerant 20 through heat exchange with the surrounding environment. The refrigerant 20 may be stored in a receiver 32 positioned downstream of the condenser 30. The receiver 32 may have any suitable size or capacity. The refrigeration system 10 also may include an expansion device 35 positioned downstream of the condenser 30. The expansion device 35 may have any suitable size or capacity. The expansion device 35 may reduce the pressure and temperature of the flow of the refrigerant 20.

The refrigeration system 10 may include an evaporator 40 or other type of heat exchanger positioned downstream of the expansion device 35. The evaporator 40 may have any suitable size or capacity. The refrigerant 20 may absorb heat in the evaporator 40. The refrigerant 20 then may be returned to the compressor 15 so as to repeat the cycle. Other components and other configurations may be used herein. The refrigeration system 10 described herein is for the purpose of example only. Many other types of refrigeration systems, refrigeration components, and refrigerants may be known and used herein.

Figure 2:
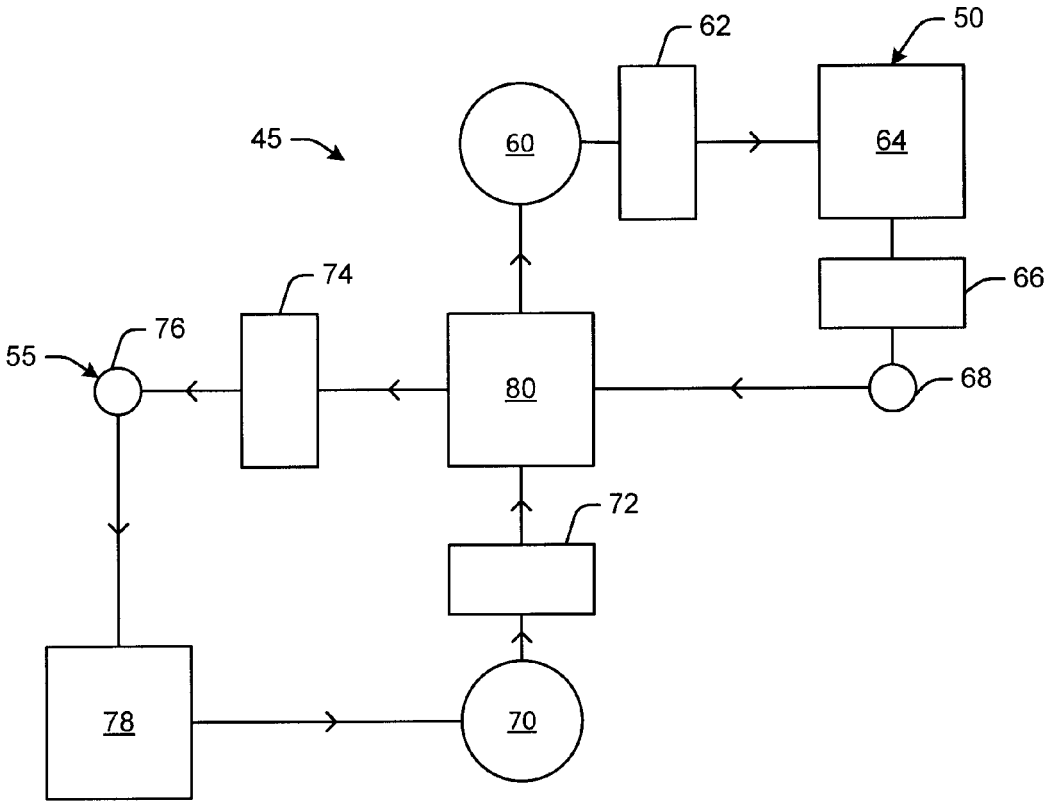
FIG. 2 is a schematic diagram of a known cascade refrigeration system with a high side cycle and a low side cycle.

FIG. 2 shows an example of a cascade refrigeration system 45. Generally described, the cascade refrigeration system 45 may include a first or a high side cycle 50 and a second or a low side cycle 55. The high side cycle 50 may include a high side compressor 60, a high side oil separator 62, a high side condenser 64, a high side receiver 66, and a high side expansion device 68. The low side cycle 55 similarly may include a low side compressor 70, a low side oil separator 72, a low side receiver 74, a low side expansion device 76, and a low side evaporator 78. The two cycles 50, 55 may interface through a cascade evaporator/condenser 80. The respective flows of the refrigerants exchange heat via the cascade evaporator/condenser 80. The cascade evaporator/condenser 80 may have any suitable size or capacity. Other components and other configurations may be used herein. The cascade refrigeration system 45 described herein is for the purpose of example only.

Figure 3:
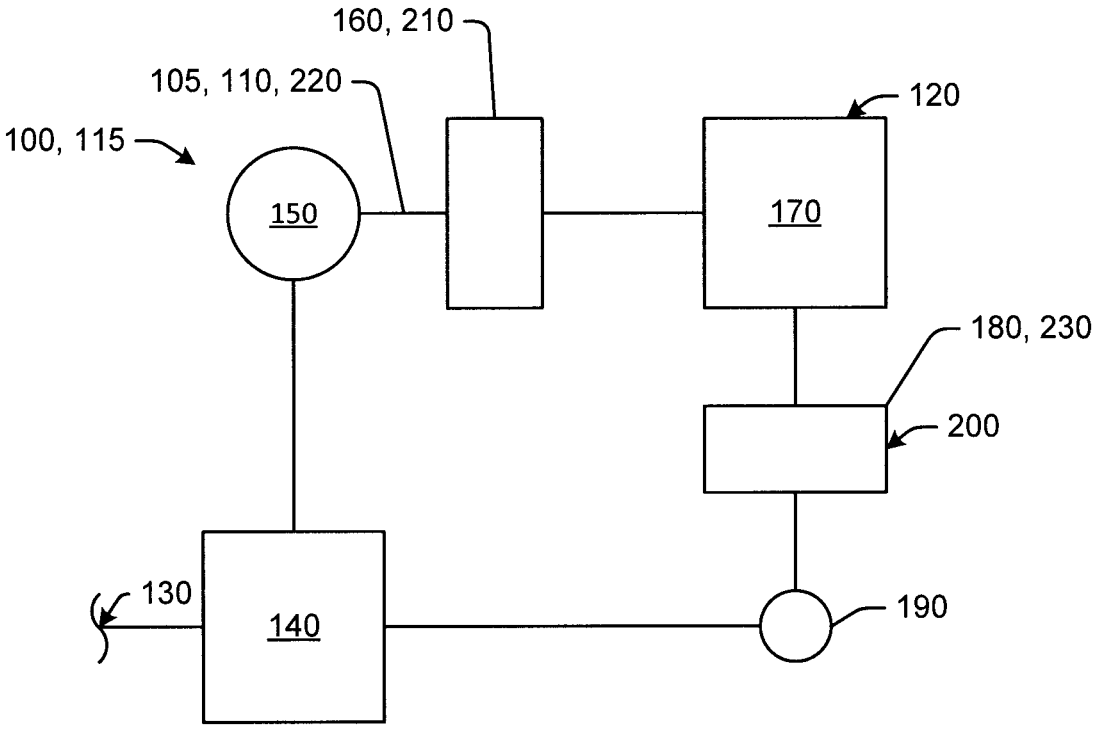
FIG. 3 is a schematic diagram of a high side cycle of a cascade refrigeration system as may be described herein.
Figure 5:
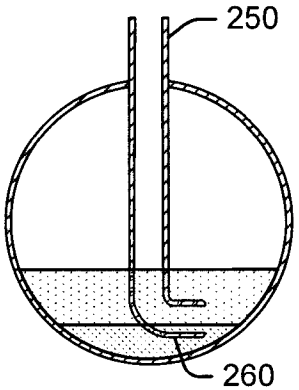
FIG. 5 is a further sectional view of the receiver of FIG. 4 showing a condenser output tube.
Figure 4:
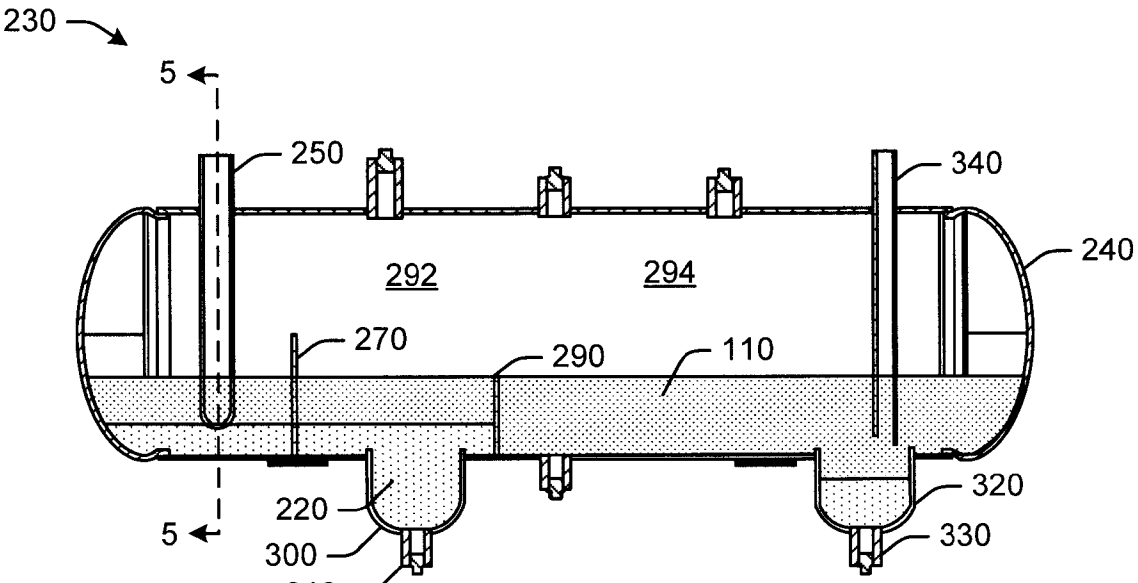
FIG. 4 is a sectional view of a receiver for use with the high side cycle of the cascade refrigeration system of FIG. 3.
Figure 7:
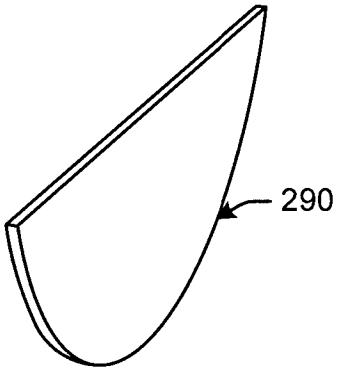
FIG. 7 is a perspective view of a weir plate for use with the receiver of FIG. 4.
Figure 6:
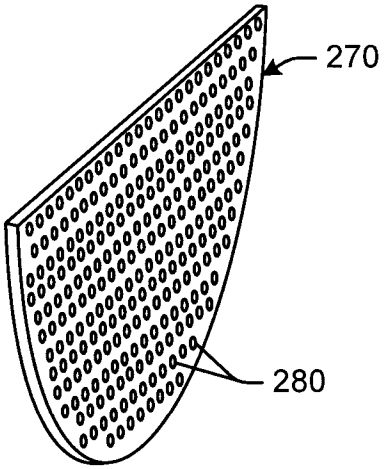
FIG. 6 is a perspective view of a turbulence isolation plate of the receiver of FIG. 4.

FIG. 3 shows a portion of a refrigeration system 100 as may be described herein. The refrigeration system 100 may use a flow of refrigerant 105. In this example, the flow of refrigerant 105 may be a flow of ammonia 110. Other types of refrigerants 105 may be used herein. Specifically, any type of immiscible mixtures may be used herein. The refrigeration system 100 may be a cascade refrigeration system 115. More specifically, a first or a high side cycle 120 is shown. The cascade refrigeration system 110 also may include a second or a low side cycle 130 similar to that described above. The cascade refrigeration system 110 may include a cascade evaporator/condenser 140. The cascade evaporator/condenser 140 may have any suitable size or capacity. The cascade evaporator condenser 140 provides the interface between the high side cycle 120 and the low side cycle 130. The high side cycle 120 also may include a high side compressor 150, a high side oil separator 160, a high side condenser 170, a high side receiver 180, and a high side expansion device 190. The high side cycle components may have any suitable size or capacity. Other components and other configurations may be used herein.

The high side cycle 120 also may include a full oil recovery system 200. The full oil recovery system 200 may include the high side oil separator 160. In this example, the high side oil separator 160 may be a full oil separator 210. The full oil separator 210 may remove most of any oil 220 remaining in the flow of refrigerant 105 downstream of the high side compressor 150. Commonly used oils such as mineral oil (MO), polyalkylene glycol (PAG), poly-alpha-olefin (PAO), and the like may be largely immiscible in ammonia and other types of refrigerants. The density of ammonia may be between about 35 to about 38 pounds per cubic foot (about 560.6 to about 608.7 kilograms per cubic meter) depending on the temperature. The density of oil may be much greater at about 60 pounds per cubic foot (about 961 kilograms per cubic meter). The full oil separator 210 may be highly efficient in removing the oil 220 flow of the refrigerant. Specifically, about 90 to about 98% of the flow of oil 220 may be removed depending upon overall system load. The full oil separator 210 may be a coalescing oil separator, a helical oil separator, and the like. The full oil separator 210 may have any suitable size, shape, configuration, or capacity.

The full oil recovery system 200 also includes the high side receiver 180. In this example, the high side receiver 180 may be in the form of a full oil recovery receiver 230. The full oil recovery receiver 230 may be generally tube or tank like 240 in shape. The tank 240 may have any suitable size, shape, or configuration. The full oil recovery receiver 230 may include a condenser output tube(s) 250. The condenser output tube 250 may be in communication with the high side condenser 170 and the flow of the refrigerant 105 therein. The condenser output tube 250 may have a curvilinear discharge end 260. The curvilinear discharge end 260 may minimize turbulence in the flow of refrigerant 105 into the tank 240.

The full oil recovery receiver 230 also may include a turbulence isolation plate 270. The turbulence isolation plate 270 may be positioned adjacent to the condenser output tube 250. The turbulence isolation plate 270 may have a number of perforations 280 therein. Any number of the perforations 280 may be used in any size, shape, or configuration. The turbulence isolation plate 270 with the perforations 280 may slow the flow of the refrigerant 105 into the tank 240 so as to reduce further the turbulence therein.

The full oil recover receiver 230 may include a weir plate 290. The weir plate 290 may be a barrier with any size, shape, or configuration so as to isolate the denser oil 220 on one side thereof or a dense or a first side 292 while allowing the lighter refrigerant 105 to separate from the denser oil due to a change in direction and spill thereover into a lighter or a second side 294. Other types of barriers or obstructions may be used herein.

The full oil recover receiver 230 may include a first oil pot 300 on the dense side 292 of the weir plate 290. The first oil pot 300 may be positioned at the lowest point in the tank 240 so as to allow the heavier oil 220 to accumulate therein under the force of gravity. The first oil pot 300 may include a first oil port 310 thereon so as to allow the flow of oil 220 to drain. The first oil pot 300 may have any suitable size, shape, or configuration. The first oil pot 300 may include accessories to detect the presence of oil for initiating an automatic oil recovery process. The full oil recovery receiver 230 also may include a second oil pot 320. The second oil pot 320 may be positioned on the lighter side 294 of the weir plate 290 so as to accumulate any oil that may have spilled over during abnormal operations when the level of refrigerant exceed the dimensions of the weir plate 290 and the like. The second oil pot 320 may have any suitable size, shape, or configuration. The second oil pot 320 may include a second oil port 330 so as to allow the flow of oil 220 to drain. The second oil pot 320 also may include accessories to detect the presence of oil for initiating an automatic oil recovery process.

The full oil recovery receiver 230 may include a refrigerant supply port 340 on the lighter side 294 of the weir plate 290. The refrigerant supply port 340 allows for the output of the separated flow of refrigerant 105 therethrough. The refrigerant output supply port 340 may have any suitable size, shape, or configuration. Other components and other configurations may be used herein.

In use, most of the flow of oil 220 in the flow of refrigerant 105 may be removed by the full oil separator 210. The flow of refrigerant 105 then passes through the high side condenser 170 and into the full oil recovery receiver 230. Any turbulence in the flow of the refrigerant 105 may be minimized by the curvilinear discharge end 260 of the condenser output tube 250 as well as by the turbulence isolation plate 270. The oil 220 therein then may settle under the force of gravity into the first oil pot 300 on the denser side 292. The lighter refrigerant 105 may wash and/or spill over the weir plate 290 and may be removed via the refrigerant supply port 340 on the lighter side 294. Any oil 220 that spills over the weir plate 290 also may be removed via the second oil pot 320. The full oil recovery receiver 230 also may include a heater (not shown) for flashing any trapped ammonia.

The full oil recovery system 200 thus may provide for the refrigeration system 100 to recover all or nearly all of the oil 220 in the high side cycle 120. The full oil recovery system 200 thus avoids the need for manual oil recovery and the associated costs generally associated with the high side cycle 120. Moreover, the low side cycle (about the expansion device and the compressor) may avoid the use of oil so as to improve further overall system performance. The full oil recovery system 200 provides such full oil recovery from the high side without the use of expensive or complex mechanisms for manual oil recovery or having elaborate arrangements for collecting, separating, and recovering oil from the low side of the refrigeration system 100 as is currently done.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A refrigeration system with full oil recovery for removing oil from a flow of a refrigerant, comprising:
- a compressor;
- an oil separator positioned downstream of the compressor to remove most of the oil from the flow of the refrigerant;
- a condenser positioned downstream of the oil separator; and
- a receiver positioned downstream of the condenser;
- the receiver comprising a barrier to separate the oil on a first side of the barrier from the refrigerant on a second side of the barrier;
- wherein the receiver comprises a condenser output tube in communication with the condenser, the condenser output tube comprising a curvilinear discharge end, wherein an outlet of the curvilinear discharge end is:
  - oriented in a direction substantially parallel to the barrier; and
  - adapted to be submerged in a flow of liquid refrigerant within the receiver.

2. The refrigeration system of claim 1, wherein the refrigeration system comprises a cascade refrigeration system.

3. The refrigeration system of claim 1, wherein the refrigerant comprises an ammonia refrigerant or any refrigerant that is immiscible with the oil.

4. The refrigeration system of claim 1, wherein condenser comprises a high side condenser and the compressor comprises a high side compressor.

5. The refrigeration system of claim 1, wherein the oil separator comprises a coalescing oil separator.

6. The refrigeration system of claim 1, wherein the receiver comprises a turbulence isolation plate positioned adjacent to the condenser output tube.

7. The refrigeration system of claim 6, wherein the turbulence isolation plate comprises a plurality of perforations.

8. The refrigeration system of claim 1, wherein the barrier separates a first side and a second side of the receiver.

9. The refrigeration system of claim 8, wherein the barrier comprises a weir plate.

10. The refrigeration system of claim 8, wherein the first side comprises a first oil pot.

11. The refrigeration system of claim 8, wherein the second side comprises a second oil pot.

12. The refrigeration system of claim 8, wherein the second side comprises a refrigerant supply port.

13. A method of removing oil from a flow of refrigerant in a refrigeration system, comprising:
- removing most of the oil in an oil separator;
- condensing the refrigerant in a condenser;
- flowing the refrigerant to a receiver;
- separating the remaining oil in the refrigerant on one side of a barrier in the receiver; and
- accumulating the remaining oil in an oil pot;
- wherein the oil flows to the oil pot along the length of the receiver and the flow of refrigerant into the receiver flows along the width of the receiver via a condenser output tube comprising a curvilinear discharge end having an outlet submerged in a flow of liquid refrigerant within the receiver.

14. A full oil recovery system for removing oil from a flow of an ammonia refrigerant in a refrigeration system, comprising:
- a coalescing oil separator; and
- a receiver, the receiver comprising:
  - a weir plate to separate the oil on a first side of the weir plate from the ammonia refrigerant on a second side of the weir plate; and
  - a condenser output tube with a curvilinear discharge end, wherein an outlet of the curvilinear discharge end is:
    - oriented in a direction substantially parallel to the weir plate; and
    - adapted to be submerged in a flow of liquid refrigerant within the receiver.

15. The full oil recovery system of claim 14, wherein the receiver comprises a turbulence isolation plate with a plurality of perforations.

16. The full oil recovery system of claim 14, wherein the first side comprises a first oil pot.

17. The full oil recovery system of claim 14, wherein the second side comprises a refrigerant supply port.

* * * * *